United States Patent [19]

Schroeder

[11] 4,308,696

[45] Jan. 5, 1982

[54] GUTTER COVER ASSEMBLY

[75] Inventor: Robert W. Schroeder, Bensenville, Ill.

[73] Assignee: Romark Technologies, Inc., Bensenville, Ill.

[21] Appl. No.: 129,419

[22] Filed: Mar. 12, 1980

[51] Int. Cl.[3] ..... E04D 13/00

[52] U.S. Cl. ..... 52/11; 219/213

[58] Field of Search ..... 52/11, 12, 13, 14, 15, 52/24; 219/213

[56] References Cited

U.S. PATENT DOCUMENTS

| | | | |
|---|---|---|---|
| 2,805,632 | 9/1957 | Couture | 52/12 |
| 2,873,700 | 2/1959 | Heier | 52/12 |
| 2,935,954 | 5/1960 | Matthews et al. | 52/12 X |
| 3,821,512 | 6/1974 | Stamford | 219/213 |
| 3,939,616 | 2/1976 | Schapker | 219/213 X |

*Primary Examiner*—Price C. Faw, Jr.
*Assistant Examiner*—Carl D. Friedman
*Attorney, Agent, or Firm*—Lester N. Arnold

[57] ABSTRACT

An improved flat-like assembly of gutter cover parts is utilized to cover open storm gutters as are commonly used on buildings, and the assembly thereof includes improved means for attachment to the gutters, improved quick connection/disconnection of separable sections thereof, and is further provided with a heater element to be made electrically conductive to precipitate the melting of accumulating ice and snow.

3 Claims, 6 Drawing Figures

GUTTER COVER ASSEMBLY

BACKGROUND OF THE INVENTION

This invention relates to protective cover assemblies for use with open-type storm gutters commonly mounted along the roof lines of building structures, and more particularly, relates to an improved gutter cover assembly having improved interconnection of the separable parts thereof and includes heater element means to be made electrically conductive for preventing accumulation of ice and snow thereon.

Open gutters are subject to blockage from accumulations of debris therein as well as from accumulations of ice and snow during winter seasons. Often the excessive weight of the ice and snow acting on the gutters causes the gutters to be damaged and/or torn from their mountings. The dam-like blockages along the elongated lengths of gutters as may be caused by any number of objects therein, prevents the normal flow of water within the gutters. It is a common problem for such accumulations of water to overflow the rims of the gutters and have prolonged contact with the adjacent areas of the building, causing water damage thereto. It is well known to be advantageous to cover the open-type gutters to prevent such accumulations of debris and/or ice and snow, and a variety of apparatus have been used to comprise suitable cover means. Some prior art cover means also include heater elements or wires for the purpose of melting accumulated ice and snow. However, the prior art cover devices suffer from disadvantages of providing suitable attachment to the gutter and to the adjacent building, also suffer from an assembly of parts lacking in versatility to obtain a multiplicity of lengths and shapes which can be suitably attached to varying gutter widths and lengths, and also further suffer from the disadvantage of providing suitable quick interconnection and disconnection of the separable cover parts and heater element means.

SUMMARY OF THE INVENTION

The present invention presents an improved gutter assembly including a first terminal end cover section, one or more main cover sections, a coupling cover section for use with two or more main cover sections and a second terminal end cover section oppositely disposed with respect to the first terminal end cover section. The separable interconnecting cover sections are relatively thin in their height dimensions and are generally elongated in their transverse or cross-sectional dimensions to present flat-like widths of separable cover sections. The main cover sections are desirably relatively elongated in their length dimensions to a much greater extent in comparison to their cross-sectional dimensions, and such main cover sections comprise the primary length sections with which to assembly a desired gutter cover. The main cover sections have one edge portion thereof turned downwardly to comprise a flange or shoulder portion which is placed to overlie the gutter rim, and the opposite edge portion thereof is extended flat to facilitate insertion beneath overlying sealing means such as the extended or flap edge of roofing shingles. Suitable clamps are provided along the bottom side of the main cover sections and are drawn tight by fastener means to grip the adjacent gutter rim. Each of the cover sections includes heater element means which are placed in physical and electrical contact with like-disposed heater element means of adjacent cover sections upon the interconnection of the separable cover sections.

It is an object of the present invention to provide a gutter cover assembly having improved assembly of parts providing separable and interconnecting cover sections and heater element means.

It is another object to provide improved yet simple attachment means by which the gutter cover sections may be secured or attached to an underlying gutter and to the adjacent roof line of the building structure.

It is a further object of the invention to provide exposed heater element means providing direct physical and electrical contact with accumulated masses of ice and snow resting on the gutter cover sections whereby electrical activation of the heater element means causes melting of ice and snow.

It is still another object to provide improved heater element means providing ease of interconnection and disconnection thereof and which heater element means is intended to meet stringent wiring and electrical codes and/or safety codes.

It is yet another object to provide an improved gutter cover assembly presenting simplicity of installation and removal.

Still a further object of the invention is to provide an assembly of separable gutter cover sections including in combination a pair of end cover sections and a predetermined number of intermediate lengths of main cover sections interconnected in end-wise fashion by coupling cover sections.

Other objects and advantages of the present invention over known gutter cover assemblies will become more obvious and apparent as the present invention is described and claimed in connection with the accompanying drawing, to wit:

THE DRAWING

DETAILED DESCRIPTION

Figure 1:
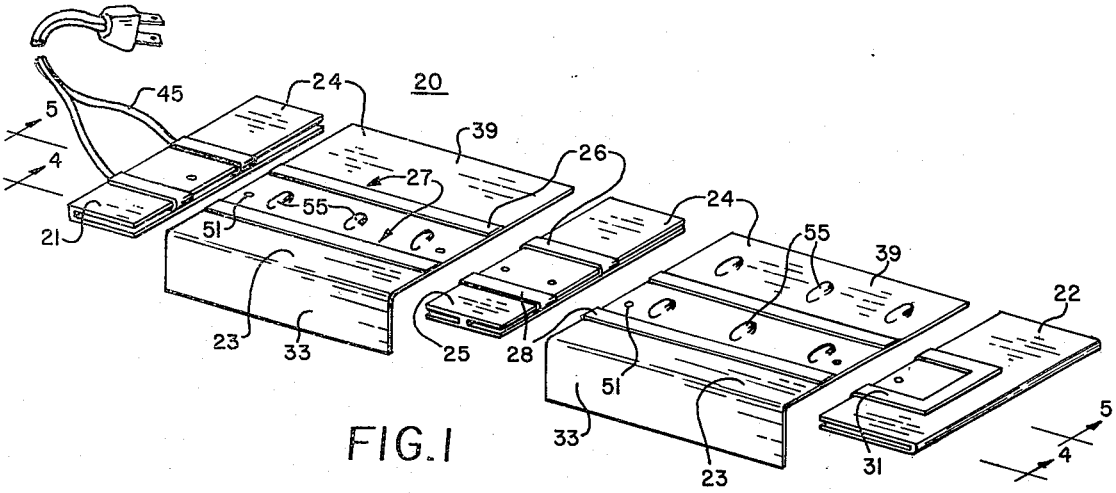
FIG. 1 is an exploded frontal view of the gutter cover assembly presented in accordance with the present invention, and shows a pair of end cover sections, a pair of main cover sections and a coupling cover section, each thereof including heater element means.

Referring to the drawing, FIG. 1 shows an improved gutter cover assembly 20 including in combination a first terminal end gutter cover section 21, a second terminal end gutter cover section 22, a pair of intermediately disposed main gutter cover sections 23 to be joined or interconnected together through use of an intermediately disposed gutter coupling cover section 25. Heater element means 27, is provided to extend lengthwise along the upper surfaces 24 of each of the aforementioned gutter cover sections. The heater element means 27 are comprised of a selected number of pairs of electrical conductive elements 26 and 28 spaced apart on the upper surface 24 of the several gutter cover sections, except that the spaced conductive elements 26 and 28 are ultimately shorted together through use of a U-shaped conductive element 31 disposed on the upper surface 24 of the second terminal end cover section 22. The several main cover sections 23 each include a front edge portion thereof which is turned downwardly (with reference to the direction shown in FIG. 1) to comprise a flange or shoulder portion 33 which is intended to overlie mounted gutter means or apparatus 30, shown only in cross-section in FIG. 2.

Figure 2:
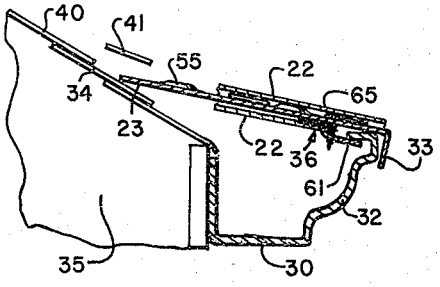
FIG. 2 is a partial or fragmentary sectional view displaying a fragmentary roof line portion of a building structure, and shows a sectioned gutter apparatus and a side or end view of an overlying and attached main gutter cover section.

It is common practice to install gutter means or apparatus 30 along the outer roof-line of building structures, such as the illustrated building structure 35 of FIG. 2, which gutter means 30 comprises a trough-like apparatus within which to catch overflowing water spilling or draining from the roof 34 of the building 35. The gutter apparatus 30 is conventionally shaped to present an upper and inwardly extending rim or flange portion 31 disposed along the entire length of an outer gutter wall 32 thereof. The rim portion 31 presents a convenient structure for cooperating with attachment means 36 of the invention providing the primary attachment of the gutter cover assembly 20 to the gutter apparatus 30.

As is readily apparent from reference to the illustration of the drawing, the several gutter cover sections comprising the composite gutter cover assembly 20 are relatively thin in their height dimensions and are generally elongated in their transverse or cross-sectional dimensions to present or comprise flat-like widths of separable gutter cover sections. The main cover sections 23 are desirably relatively elongated in their length dimensions to a much greater extent in comparison to their width or cross-sectional dimensions, and such main cover sections 23 comprise the primary length section with which to assemble a desired gutter cover apparatus 20. The main cover sections 23 are extended flat-like along the edge portions thereof, numbered 39 in the drawing, lying opposite from the flange portions 33. The flat-like edge portion 39 is readily insertable under the extended flap edge of the roofing shingles 40 of FIG. 2, or alternatively, a separate and overlying sealing means 41 (preferably in elongated strip configuration not clearly shown in the drawing), can be utilized to cover the edge portion 39 of the main cover section 23 as well as the corresponding edge portions of the cover sections 21, 22 and 25. Hence, the underlying gutter apparatus 30 is covered and sealed from receiving any leakage of fluids or lodging of debris. The particular manner by which the gutter means 30 is to be secured to the building 35 is outside of the scope of this invention and is also well within the state of the prior art. The omission of such commonly known details is believed to be in the interest of brevity and does not pertain to critical details needed for an enabling disclosure of the present invention.

Without the use of a suitable gutter cover assembly such as the gutter cover assembly 20 of this invention, the gutter means 30 is subject to being filled with debris constituting dam-like blockages to prevent the normal drain of water from the roof of the building and along the elongated length of the trough-like gutter means 30. Accumulated masses of ice and snow can also cause such blockages, and with the presence of blockages the back-swell of water overflowing the gutter means 30 is known to result in damage to the building 35. The use of a gutter cover eliminates and prevents the accumulations of blockages in the gutter means 30, and the use of heater element means 27 in combination with the gutter cover assembly 20 provides the advantage of melting accumulated masses of ice and snow and maintaining the gutter cover 20 free of the excessive weights thereof. Such excessive weights are known to cause deformation of the gutter means 30 and/or cause the tearing of the gutter from its mountings to the building 35. Heretofore, some prior art uses of heater elements have been simply to extend such heater elements within the trough-like gutters, in direct contact with the gutter, and hence do not prevent blockages that are caused by accumulations of debris. Prior art gutter covers which may employ heater element means in combination therewith, are not known to provide the versatility of coupling the separable cover length sections as presented by the present invention wherein the heater element means are also simultaneously interconnected.

In accordance with the present invention, the heater element means 27 is comprised of discontinued but interconnectable lengths of the spaced conductive strips or substances 26 and 28. The first end cover section 21 includes such conductive strips 26 and 28, and electrical interconnection to these strips 26 and 28 are readily provided from or to an external source of electric power (not shown) as through the use of an extendable electric cord 45 of FIG. 1. The provision of the particular connections of the cord 45 with the conductive strips 26 and 28 is well within the skill of the practitioner of the pertinent art, and is not provided in detail herein.

Figure 4:
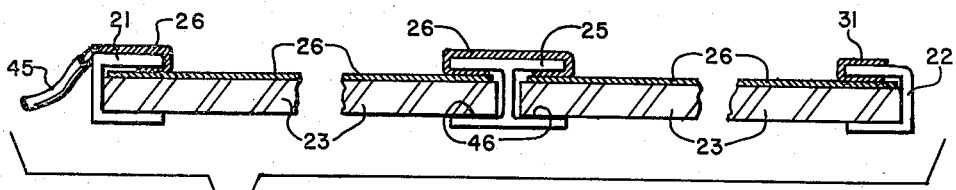
FIG. 4 is a sectional edge view of the assembly of gutter cover sections of FIG. 1 taken generally along the line 4—4 of FIG. 1, and therein shows the manner of physical and electrical interconnection of heater element means.

The first end cover section 21 is desirably U-shaped so as to telescopically receive the inserted end portion of a main cover section 23, as is clearly shown in FIG. 4. It is hence convenient to provide electrical contact between corresponding conductive strips on each of the cover sections 21 and 23, that is, strip 26 on cover section 21 to strip 26 on cover section 23, etc., by wrapping the conductive strips 26 and 28 around the upper and outer edge portion of the top surface 24 in order to continue the conductive strips 26 and 28 along the underside of the top leg portion of the U-shaped cover section 21. It is at once apparent that with the conductive strips 26 and 28 being disposed along the upper surface 24 of the main cover section 23 in longitudinal alignment with the conductive strips 26 and 28, respectively, of the end section 21, the simple act of insertion of the end portion of the main cover section 23 into the U-shaped end section 21 will effect physical and electrical contact between the aligned conductive strips 26 to 26 and 28 to 28, and without any use of electrical coupling devices. The relative dimensions of parts can be designed to provide a snug inserted-fit between parts.

The intermediate coupling section 25 is configured to comprise a so-called double or back-to-back U-shaped sections or an I-shaped section providing oppositely disposed spaces 46 within which to receive inserted end portions of main cover sections 23 as shown in FIG. 4. The conductive strips 26 and 28 are again wrapped around the upper and outer edge portion of the top surface 24 thereof in order to continue the conductive strips 26 and 28 into the spaces 46. The structured configuration of the second end section 22 is to be understood to be identical to the configuration of the first end section 21, except that the conductive strip 31 is U-shaped along the upper surface 24 of the end section 22 to accomplish the electrical interconnection of the conductive strips 26 and 28 at the terminal end of the gutter cover assembly 20.

Figure 5:
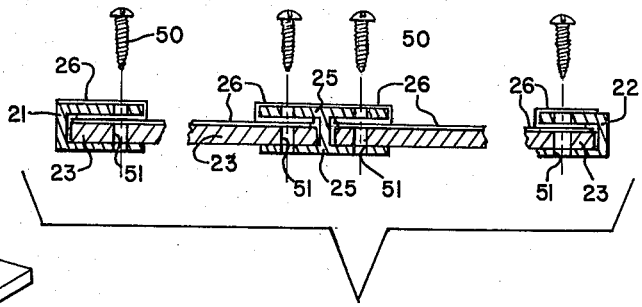
FIG. 5 is an alternative sectional edge view as taken generally along the line 5—5 of FIG. 1 and shows fastener means employed to capture the coupled edge portions of the several interconnected cover sections.

Once the several cover sections of the drawing have been insertedly fitted together, the fastener means 50 are used to interconnect the plugged cover sections; this is clearly shown in FIG. 5. The cover sections 21, 22, 23 and 25 are provided with suitable apertures 51 which become aligned and permit the passage of the fastener means 50 therethrough in a conventional use of fastener devices. It is not intended that the fastener means 50 attach to the gutter means 30 or to the building 35. It has been discovered by the inventor that the flat-like expansions of the upper surfaces 24 of the main cover sections 23 are desirably made more rigid and supportable by the inclusion of a plurality of ridge-like flanges or domes 55 which appear as indentations from beneath the main cover sections and raised domes from the upper surface 24 thereof. Other means of providing such rigidity to the flat-like main cover sections 23 can just as well be employed, and the domes 55 are only suggestive of one such provision.

The conductive strips 26, 28 and 31 can be comprised of any number of compositions of conductive material and the composition of material is not intended to be a part of this invention. It is even possible to utilize tape-like conductive material, and the relative thickness and/or widths thereof can be widely varied without affecting the scope and intent of the present invention. The electric power source can be provided by a direct connection of the line cord 45 to the standard 110 volt AC electric outlet readily available in the building. The flange portion 33 can be made to turn downwardly at a ninety (90) degree angle, and the downward extension thereof can be varied widely so long as an adequate rim portion is provided to prevent the attached cover assembly 20 from becoming easily dislodged.

Figure 3:
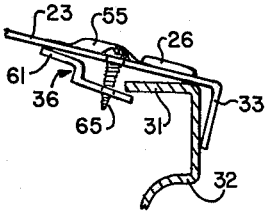
FIG. 3 is an enlarged isolated view of the attachment of the main gutter cover section to the adjacently disposed and underlying gutter rim.
Figure 6:
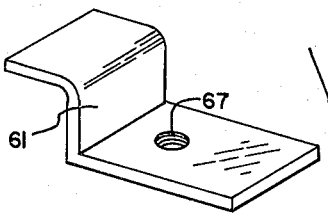
FIG. 6 is an enlarged prospective view of a primary embodiment of the gutter clamp shown in FIGS. 2 and 3.

FIGS. 2 and 3 show the attachment means 36 which are comprised of an off-set clamp 61, shown in perspective in FIG. 6, and fastener means 65. The clamp or bracket 61 is not permanently attached to the main cover section 23 but is drawn into engagement with the bottom side thereof, through threaded engageable tightening action with respect to the receipt of the fastener means 65 within the threaded aperture 67. The inner edge portion of the rim 31 of the gutter means 30 is intended to be captured by the tightened clamp 61 so as to be gripped between the clamp 61 and the bottom surface of the main cover section 23. Several of the clamps 61 can be provided in spaced apart relationship along the underside of the main cover sections 23. The cooperation of the clamping action of the clamps 61 onto the rim portion 31 of the gutter means 30 and the sealing of the edge portion 39 either under roofing shingles 40 or the separate sealing strip 41 serves to adequately mount the improved cover assembly 20 of the present invention. The use of a simple screwdriver will be all that is needed to interconnect the separable cover sections and to make the attachment of the integral cover section assembly 20 to the gutter means 30 and the building 35.

The present invention provides an improved gutter cover assembly 20 for use with open-type gutter apparatus 30, and includes in combination a predetermined plurality of flat-like elongated cover means 23 placed in position to cover the trough-like elongated opening of the gutter apparatus 30, coupling cover means 25 for coupling together adjacent pairs of the elongated cover means 23, the coupling means 25 providing U-shaped portions thereof to be telescopically clamped over adjacent end portions of the elongated cover means 23 for comprising a continuous coupled plurality of the elongated cover means 23, a pair of terminal end cover means 21 and 22 providing U-shaped leg portions thereof to be telescopically clamped over adjacent end portions of a first one and a final one of the coupled plurality of elongated cover means 23, respectively, first fastener means 50 for securing the clamped adjacent end portions of the elongated cover means 23, and heater element means 27 extending lengthwise along the upper surfaces of the elongated cover means 23, the coupling means 25 and terminal end cover means 21 and 22, respectively, each extension of the heater element means 27 being in longitudinal alignment with each other extension of heater element means 27 to provide a continuous aligned heater element means 27, and the extensions of heater element means 27 on the coupling means 25 and the terminal end cover means 21 and 22 being deposited to extend over the edge portions of the upper leg portions thereof and onto the bottom surfaces thereof, respectively, for placing the extensions of heater element means 27 on the elongated cover means 23 in physical and electrical contact with the extensions of heater element means 27 on the clamped coupling cover means 25 and the clamped terminal end cover means 21 and 22. Attachment clamp means 36, including a clamp 61 and fastener means 65, are employed to connect the elongated cover means 23 to the outer and upper rim portion 31 of the gutter means 30, wherein the tightening of the fastener means 65 in threaded engagement with the clamp 61 draws a free end portion of the clamp 61 toward the bottom surface of the elongated cover means 23 to capture therebetween the outer rim portion 31 of the gutter means 30. The elongated cover means 23 further include the downwardly extending edge portions 33 which define a flange useful to cover the outer rim 31 of the gutter means 30. The oppositely disposed edge portions 39 of the elongated cover means 23 are preferably flat-like and are readily extendible under overlying sealing means 41 to provide the seal covering of the open-type gutter apparatus 30.

It is to be understood that while the present invention has been shown and described with respect to a preferred embodiment thereof, the scope of the invention is not intended to be so limited and other equally suitable and equivalent modifications, configurations and changes may be made therein without departing from the spirit and scope thereof.

I claim:

1. An improved gutter cover assembly useful for covering open-trough gutter apparatus attachable to roof lines of building structures comprising in combination flat-like elongated length cover section means extendable lengthwise to cover the open-trough gutter apparatus, coupling cover section means interconnecting adjacently positioned pairs of the flat-like cover section means, each of the coupling cover section means including oppositely opening U-shaped pairs of leg portions thereof, each of said pairs of leg portions to be clamped over an adjacent end portion of the flat-like cover section means for providing a continuous plurality of end-to-end coupled flat-like cover section means, terminal end cover section means including U-shaped pairs of leg portions to be clamped over uncoupled end portions of the flat-like cover section means, respectively, to provide spaced apart terminal end cover section means for terminating the intercoupled plurality of flat-like cover section means, clamping means for attaching the intercoupled gutter cover assembly to the covered gutter apparatus, and electrically conductive heater element means comprising spaced apart conductive strip means being axially aligned to extend along the coupled plurality of flat-like cover section means, coupling cover section means and terminal end cover section means collectively, said conductive strip means being disposed on the U-shaped leg portions of the coupling cover section means and the terminal end cover section means, respectively, to extend continuously from a selected outer surface thereof onto the corresponding inner surface thereof, and the conductive strip means disposed on the inner surface of the leg portions thereof being electrically engageable with the axially aligned conductive strip means disposed on the flat-like cover section means with the leg portions of the coupling cover sections and terminal end cover sections being clamped over the adjacently disposed end portions of the flat-like cover section means, respectively.

2. An improved gutter cover assembly as claimed in claim 1 wherein the spaced apart conductive strip means are electrically interconnected on the terminal end cover section means.

3. An improved gutter cover assembly for covering open-trough type gutter apparatus for building structures comprising in combination: a plurality of flat-like cover section means generally elongated in their length dimension and being extendable in end-to-end abutting dispositions for providing covering means for the open-trough gutter assembly, each thereof having one lateral edge portion comprised of a downwardly turned flange means to be disposed to overlie a selected edge portion of the gutter apparatus and having the other and oppositely disposed lateral edge portion thereof extending outwardly in a common plane to be insertable with roofing cover means for the building structure, a plurality of coupling cover section means for interconnecting abutting end portions of adjacently disposed pairs of end-to-end flat-like cover section means, each of the coupling cover means including oppositely opening pairs of U-shaped leg portions to be clamped over the abutting end portions of the flat-like cover means, respectively, for coupling together an end-to-end disposed pair of flat-like cover means, terminal end cover section means, having U-shaped leg portions to be clamped over the terminal uncoupled end portions of the extended plurality of coupled end-to-end disposed flat-like cover means for terminating the interconnected plurality of flat-like cover means, clamping means for clamping the interconnected plurality of flat-like cover means to the gutter apparatus, and electrically conductive heater element means comprising spaced apart conductive strip means being axially aligned to extend along the coupled plurality of flat-like cover means, coupling cover means and terminal cover means collectively, said spaced strip means being disposed on the coupling cover means and terminal cover means to extend continuously along selected outer surfaces of the U-shaped leg portions and continuously onto the corresponding inner surfaces thereof, respectively, for providing electrical continuity therebetween, the conductive strip means as disposed on the inner surfaces of the U-shaped leg portions thereof being electrically engageable with the axially aligned conductive strip means disposed on the flat-like cover means, respectively.

* * * * *